US006453890B1

(12) United States Patent
Kageyama et al.

(10) Patent No.: US 6,453,890 B1
(45) Date of Patent: Sep. 24, 2002

(54) SUPERCHARGED ENGINE

(75) Inventors: Hidetoshi Kageyama; Nobuaki Karaki, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/648,835

(22) Filed: Aug. 25, 2000

(30) Foreign Application Priority Data

Sep. 9, 1999 (JP) ..... 11-255920

(51) Int. Cl.[7] ..... F02B 33/00

(52) U.S. Cl. ..... 123/559.1; 123/571; 123/192.2; 123/65 BA

(58) Field of Search ..... 123/559.1, 192.2, 123/571, 65 BA

(56) References Cited

U.S. PATENT DOCUMENTS

| | | | | |
|---|---|---|---|---|
| 1,472,012 A | | 10/1923 | Leonar | |
| 2,292,233 A | * | 8/1942 | Lysholm | 123/559.1 |
| 4,561,253 A | * | 12/1985 | Curtil | 123/559.1 |
| 5,101,794 A | * | 4/1992 | Van Blaricom | 123/65 BA |
| 5,179,921 A | | 1/1993 | Vincent | |
| 5,357,936 A | * | 10/1994 | Hitomi et al. | 123/571 |
| 5,375,581 A | | 12/1994 | Gerd et al. | |
| 5,535,643 A | * | 7/1996 | Garza | 123/192.2 |
| 5,713,330 A | * | 2/1998 | Hitomi et al. | 123/559.1 |
| 5,715,784 A | * | 2/1998 | Okui et al. | 123/192.2 |
| 5,730,586 A | * | 3/1998 | Sayama | 123/564 |
| 5,775,283 A | * | 7/1998 | Sawai et al. | 123/184.53 |
| 5,791,309 A | * | 8/1998 | Yamazaki et al. | 123/192.2 |
| 5,860,402 A | * | 1/1999 | Sakurai et al. | 123/192.2 |
| 5,911,211 A | * | 6/1999 | Uchida | 123/559.1 |
| 6,029,637 A | * | 2/2000 | Prior | 123/559.1 |

FOREIGN PATENT DOCUMENTS

| | | | | |
|---|---|---|---|---|
| EP | 0 392 321 A | | 10/1990 | |
| FR | 2 378 179 A | | 8/1978 | |
| JP | 401262322 A | * | 10/1989 | 123/559.1 |

* cited by examiner

*Primary Examiner*—Thomas Denion
*Assistant Examiner*—Thai-Ba Trieu
(74) *Attorney, Agent, or Firm*—Ernest A. Beutler

(57) ABSTRACT

A compact supercharged internal combustion engine, wherein the supercharger is mounted above the twin overhead cam cylinder head of the engine but is readily detachable from it. The drive for the pumping elements of the supercharger including counter rotating shafts to which balance masses are added so as to assist in engine balancing. In addition to supplying compressed air to the combustion chambers of the engine for combustion, the supercharger also supplies air to an air injection system that cooperates with the exhaust system for reducing the emissions of undesirable pollutants to the atmosphere.

15 Claims, 3 Drawing Sheets

SUPERCHARGED ENGINE

BACKGROUND OF THE INVENTION

This invention relates to a supercharged engine and more particularly to an improved, compact, supercharged internal combustion engine.

There is a continuing demand on the designers of internal combustion engines to increase the power output of those engines and at the same time maintain both the engine compact and easily serviceable. Supercharging offers one way in which this goal can be achieved, although the use of engine driven superchargers as opposed to turbo-chargers gives rise to problems in arranging the drive for the supercharger and mounting it in an appropriate location where it can efficiently serve the induction system without interfering with the serviceability of the engine.

It is, therefore, a principal object to this invention to provide an improved, compact, supercharged internal combustion engine.

The inventors hereof have found that the overall engine construction can be simplified and the other goals still met if the supercharger performs additional functions than merely compressing the air delivered to the combustion chambers for combustion purposes. For example, engines frequently use air injection system for injecting air into the exhaust in order to improve the oxidation of unburned hydrocarbons and other potentially harmful pollutants. Also, engines frequently employ balance shafts in order to permit the use of smaller crankshafts and higher engine speed. Normally air pumps are separately driven from the engine to provide the air injection and the balancer shaft is built into the engine.

In accordance with a principal object to this invention, it is a purpose thereof to incorporate other functions into the supercharger of an engine, which normally had required separate components for their utilization.

It is a further object to this invention to provide an improved and compact supercharger for an engine that is mounted in such a way to make the engine accessible and to simplify the supply of the compressed charge to the combustion chambers of the engine.

It is a further object to this invention to provide a supercharger drive arrangement that incorporates a balancer shaft for balancing the engine.

It is a still further object to this invention to provide a supercharger arrangement herein the supercharger also supplies air for injection into the exhaust system to reduce pollutants.

SUMMARY OF THE INVENTION

A first feature of this invention is adapted to be embodied in a supercharged, twin overhead camshaft, inline internal combustion engine. The engine has a cylinder head that journals a pair of camshafts that rotate about parallel, longitudinally extending axes on opposite sides of the cylinder head assembly for operating valves therein. A cam cover encloses the portion of the cylinder head in which the camshafts are journalled. A supercharger is mounted above the cylinder head assembly and in an area generally overlying but primarily between the rotational axes of the camshafts.

In accordance with another feature of the invention, a supercharger is driven by an engine crankshaft for delivering a compressed air charge to the combustion chambers of the engine for combustion of fuel therein. In addition, a portion of the compressed air delivered by the supercharger is delivered to the exhaust ports of the engine for reducing the discharge of undesirable pollutants to the atmosphere.

In accordance with a still further feature of the invention, an engine is provided with a supercharger that is driven by the engine output shaft. The supercharger drive includes an elongated shaft having a balance mass thereon for balancing at least in part the unbalanced forces generated by the engine operation.

DETAILED DESCRIPTION OF THE PREFERRED EMBODIMENT OF THE INVENTION

Figure 1:
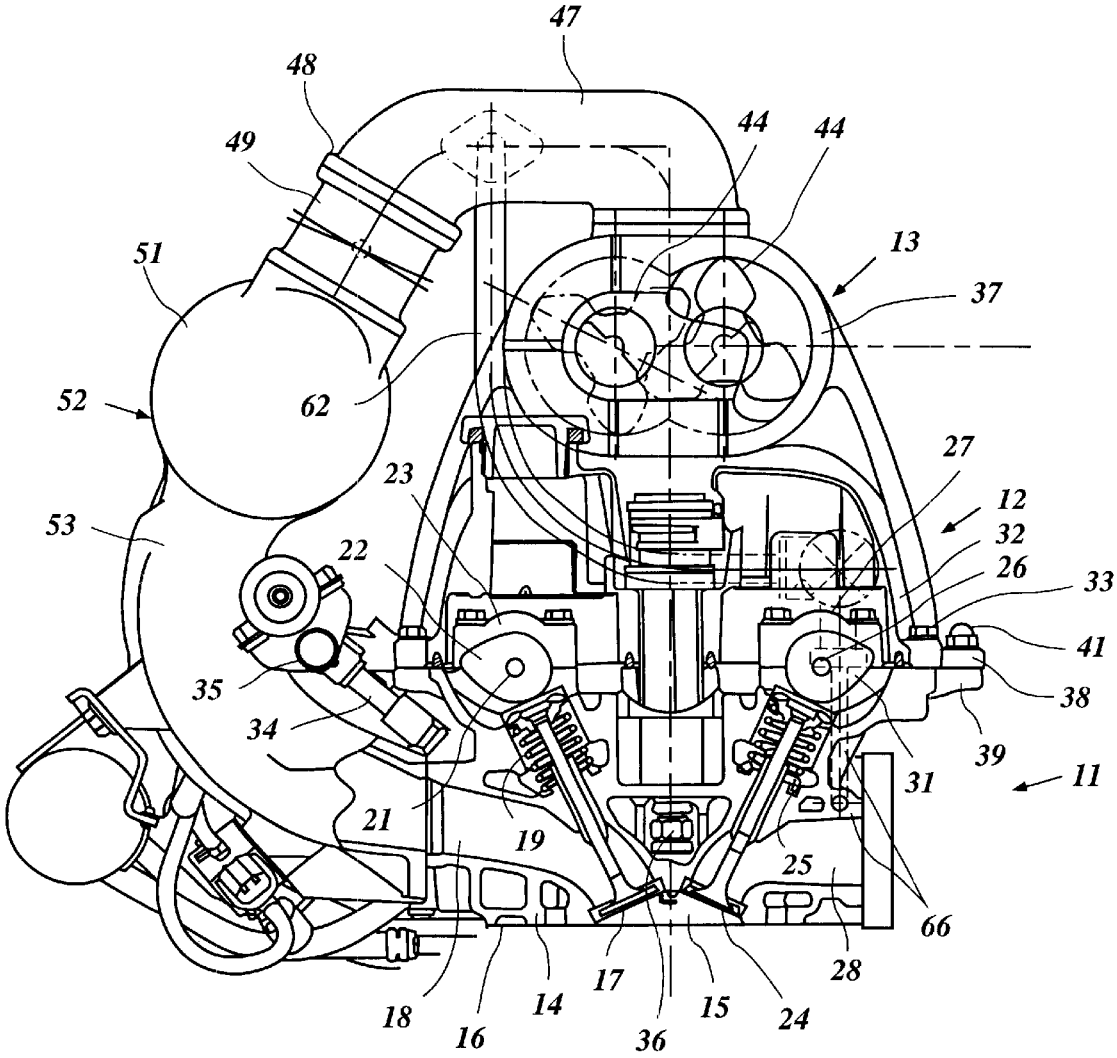
FIG. 1 is an end elevational view of the cylinder head assembly of a supercharged, internal combustion engine constructed in accordance with an embodiment of the invention; with portions broken away so as to more clearly show the construction.

Referring now in detail to the drawings, a supercharged engine constructed in accordance with an embodiment of the invention is identified generally by the reference numeral 11 and is shown only partially. More specifically, the engine 11 is comprised of a cylinder head assembly, indicated generally by the reference numeral 12, which incorporates as a sub-assembly thereto a supercharger, indicated generally numeral 13.

The cylinder head assembly 12 is designed to be associated with a cylinder block which is not shown and which can be of any generally known or desired construction. In the illustrated embodiment, the engine is of a four-cylinder, inline type and, as will become apparent from the following description, contains a pair of twin overhead camshafts. Although certain features of the invention can be utilized with engines having other cylinder numbers and other cylinder configurations, from the following the description it will be generally apparent to those skilled in the art how the construction has particular utility with twin overhead camshaft engines.

The cylinder head assembly 12 includes a main cylinder head member 14 that defines in its lower surface a plurality of recesses 15 which cooperate with the cylinder bores of the associated cylinder block to form the combustion chamber thereof along with the pistons that reciprocate in these cylinder bores. The recesses 15 are surrounded by a lower surface 16 of the cylinder head 14 that is designed to be brought into sealing engagement with the associated deck of the cylinder block.

In the illustrated embodiment, the engine 11 is of the four valve per cylinder type and to this end, a pair of intake valves 17 are mounted in valve guides in the cylinder head member 14 for valving valve seats formed at the termination of intake ports 18 formed in the cylinder head member 14 and which open though a side face thereof. The intake valves 17 are normally biased to their closed positions by means of a spring arrangement such as coil springs 19 that cooperate with keeper retainer assemblies on the stems of the valves 17 to urge them to a closed position.

An intake camshaft 21 has individual cam lobes 22 that cooperate with the intake valves 17 for effecting their opening. This action may be through thimble tappets as illustrated or by any other suitable valve actuating system. The intake camshaft 21 is journalled in the cylinder head member 14 by bearing surfaces formed integrally therewith and bearing caps 23 that are detachably connected to the cylinder head member 14. An induction system, to be described later, supplies an air charge to the combustion chambers through the intake passages 18.

Figure 2:
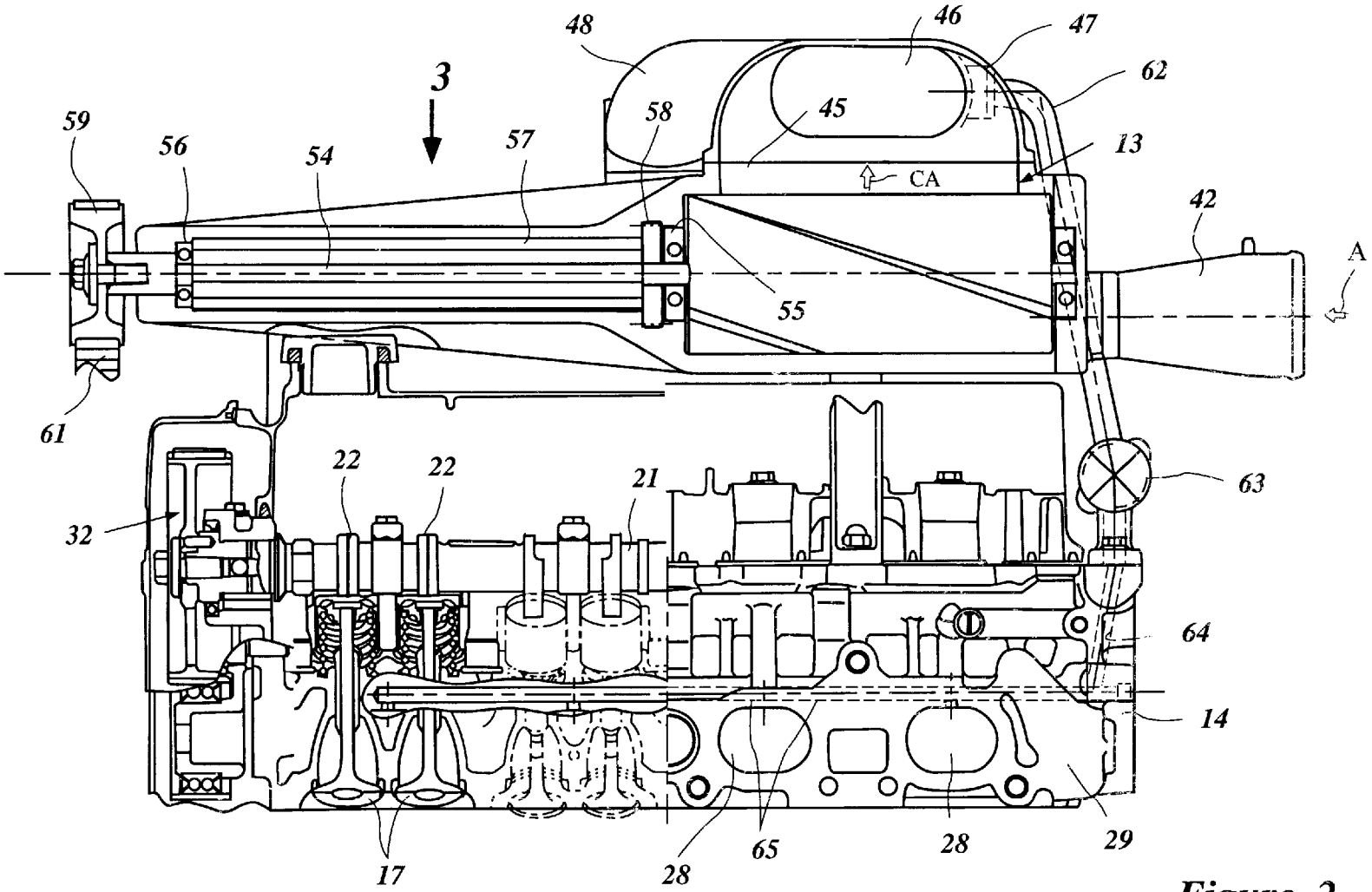
FIG. 2 is a side elevational view of the cylinder head assembly shown in FIG. 1 with portions broken away and shown in section.
Figure 3:
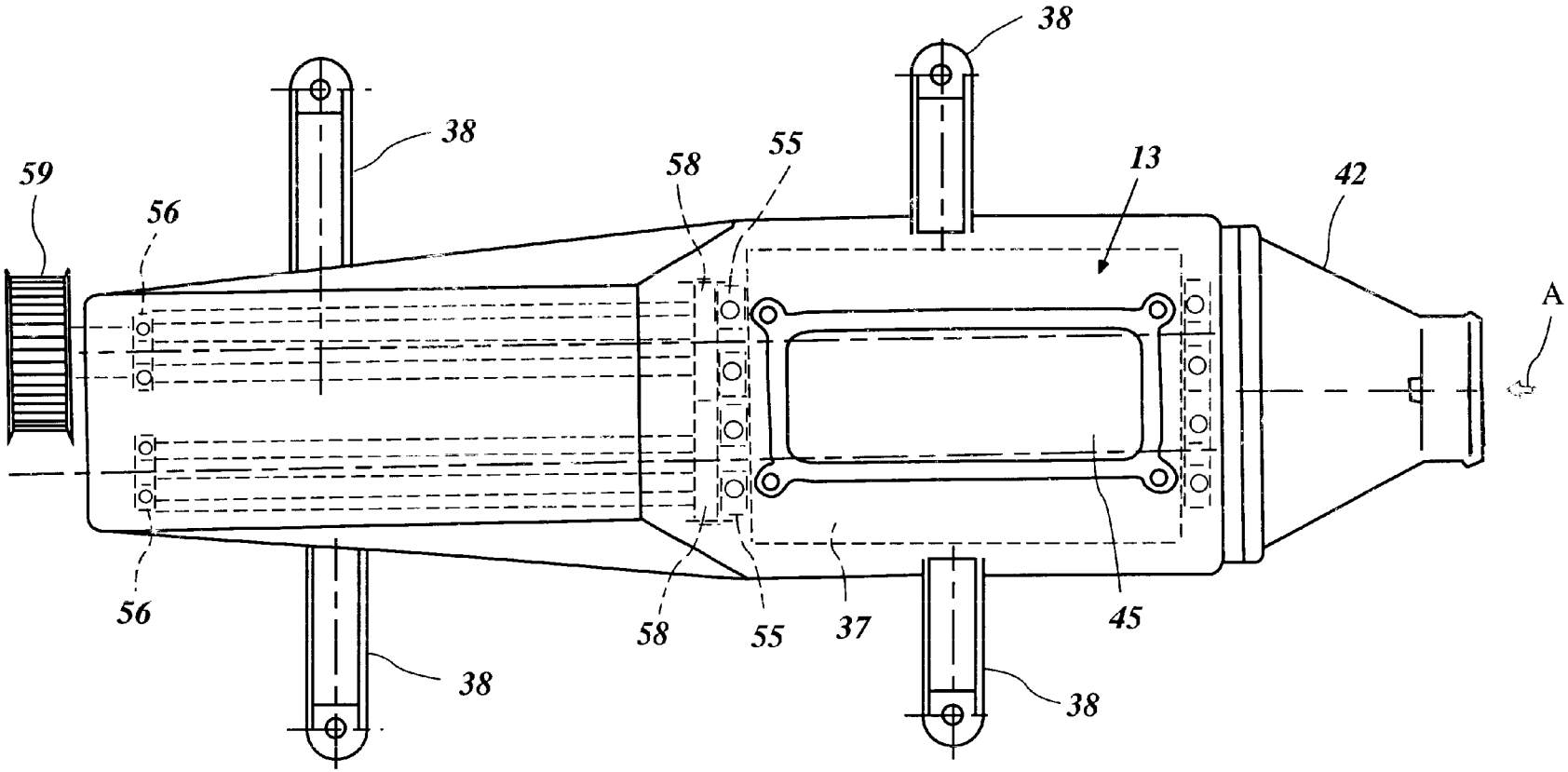
FIG. 3 is a top plan view of the supercharger assembly looking in the direction of the arrow 3 in FIG. 2.

Also formed in the cylinder head recess 15 are exhaust ports that are valved by exhaust valves 24. Like the intake valves 17, the exhaust valves 24 are urged to their closed position by coil compression spring assemblies 25 or any other suitable type of arrangement. An exhaust camshaft 26 is journalled in the cylinder head member 14 in a manner similar to the intake camshaft 21 by means that include bearing caps 27. The exhaust ports are formed at the inlet ends of Siamese exhaust passages 28 that extend through the side of the cylinder head member 14 opposite the intake passages and which open in an outer surface thereof as best seen in FIG. 2 wherein this outer surface is indicted by the reference numeral 29. An exhaust manifold (not shown) is affixed to the surface 29 in a known manner.

The exhaust camshaft 26 has cam lobes 31 that cooperate with suitable actuators for opening the exhaust valves 24.

A suitable timing drive, shown partially in FIG. 2 and indicated generally by the reference numeral 30, is provided for driving the intake and exhaust camshafts 21 and 26, respectively, at one half crankshaft speed.

The camshafts 21 and 26 are contained within a valve chamber that is formed above the cylinder head member 14 and which is closed by a cam cover 32 that is affixed to a peripheral edge thereof by threaded fasteners 33.

The engine 11 is provided with a fuel injection system that includes fuel injectors which appear in FIG. 1 and which are identified by the reference numeral 34. These fuel injectors 34 are supplied with fuel from a suitable supply source including a fuel rail 35. The injectors 34 may direct their spray either into the intake passages 18 (manifold injection) or directly into the combustion chamber recesses 15 (direct injection).

The charge formed with the incoming air is ignited by spark plugs 36 that are mounted centrally in the cylinder head between the camshafts 21 and 26. The spark plugs 36 are fired by any suitable ignition system using any desired timing strategy.

Referring now to the construction of the compressor or supercharger 13, this construction appears in all figures and includes an outer housing assembly 37 that is formed with four mounting lugs 38. These mounting lugs 38 are adapted to be supported on extensions 39 of the cylinder head member 14 by means of threaded fasteners 41. This construction permits a compact arrangement and nevertheless one that can be readily detached for servicing purposes.

The housing assembly 37 is formed with an air inlet portion 42 that receives atmospheric air as indicated by the arrow A from a suitable air source which may include an cleaner and/or silencer depending upon the application in which the engine 11 is used. The housing assembly includes a pair of intermeshing rotors or pumping vanes 44 which may be curved to provide what is known in the art as a "roots type supercharger". The air inlet 42 delivers air to these vanes and is then compressed for delivery through an upwardly extending discharge opening 45 as seen best in FIG. 2 where the compressed air flow is indicated by the arrow CA. A sidewardly opening, compressed air outlet passage 46 is formed by a closure piece 47 that is affixed across the upper end of the opening 45 in the main housing piece 37.

This closure piece 47 is also formed with an outlet fitting 48 at a point centrally along the longitudinal length of the engine and which cooperates with a throttle body 49 in which a flow controlling throttle valve is positioned. This throttle body then communicates with an inlet opening to a longitudinally extending plenum chamber 51 of an intake manifold, indicated generally by the reference numeral 52. This intake manifold 52 has runner sections 53 that extend from the plenum chamber 51. The runner sections 53 each cooperate with a respective one of the cylinder head intake passages 18 for delivering the compressed air thereto. Thus, it should be seen that the construction is quite compact.

The pumping vanes 44 of the supercharger 13 are driven by a pair of combined drive and balance shafts 54. These shafts 54 are journalled at their aft ends by bearings 55 and at their forward ends by bearings 56 that are held in the housing assembly 37. Balance masses 57 are affixed to each of the impeller drive shafts 54 and these shafts are rotated in opposite directions by intermeshing gears 58. A drive sprocket 59 is affixed to the extending end of one of the impeller drive shafts 54 and is driven from the crankshaft of the engine through a flexible transmitter such as a toothed belt 61.

Thus, it should be readily apparent that the supercharger even though it may overlie to some extent the spark plugs 36 it can be readily removed from the engine for any engine servicing by mere removal of the threaded fasteners 41 and loosening the tension on the drive belt 61.

In addition to these functions, the supercharger 13 also supplies compressed air to the exhaust system for reducing the amount of undesirable pollutants discharged to the atmosphere. To this end, the cover piece 47 has a bleed tap that communicates with an exhaust purifying air supply tube 62 which, in turn, extends to a control valve 63 mounted at the rear end of the cylinder head member 14 and which communicates with an air gallery formed therein.

This air gallery includes an inlet drilling 64 formed in the cylinder head member 14 which is intersected by a longitudinally extending drilling 65 which, in turn, intersects further drillings 66 formed along the cylinder head member 14 in registry with each of the exhaust passages 28 immediately downstream of the exhaust valves 24. As a result, the air for this system is supplied without the need for a separate pump further resulting in the compactness of the overall engine assembly.

It should be apparent that the foregoing description is that of a preferred embodiment of the invention and various changes and modifications may be made without departing from the spirit and scope of the invention, as defined by the appended claims.

What is claimed is:

1. A supercharged, twin overhead camshaft, inline internal combustion engine, said engine having a cylinder head assembly that journals a pair of camshafts that rotate about parallel, longitudinally extending axes on opposite sides of said cylinder head assembly for operating valves therein, a cam cover enclosing the portion of said cylinder head assembly in which the camshafts are journalled, and a supercharger mounted above said cylinder head assembly and in an area generally overlying but primarily between the rotational axes of said camshafts, said cylinder head assembly including a main cylinder head member and the cam cover is affixed thereto, said supercharger being detachably affixed directly to said main cylinder head member.

2. A supercharged, twin overhead camshaft, inline internal combustion engine, as set forth in claim 1 wherein the supercharger is driven from an output shaft of the engine by a flexible transmitter.

3. A supercharged, twin overhead camshaft, inline internal combustion engine, as set forth in claim 2 wherein the supercharger has a pair of intermeshing rotors contained within an outer housing and have a length less than that of the cylinder head assembly.

4. A supercharged, twin overhead camshaft, inline internal combustion engine, as set forth in claim 3, wherein the supercharger outer housing forms an air inlet that faces toward one end of said engine.

5. A supercharged, twin overhead camshaft, inline internal combustion engine, as set forth in claim 3 wherein the supercharger outer housing forms a compressed air outlet on an upper surface that cooperates with an intake manifold for serving inlet ports on one side of the cylinder head member.

6. A supercharged, twin overhead camshaft, inline internal combustion engine, as set forth in claim 5 wherein the intake manifold includes a plenum chamber from which a plurality of runners extend to the cylinder head member inlet ports.

7. A supercharged, twin overhead camshaft, inline internal combustion engine, as set forth in claim 6 wherein the intake manifold plenum chamber communicates with the supercharger outer housing compressed air outlet via a throttle body.

8. A supercharged, twin overhead camshaft, inline internal combustion engine, as set forth in claim 7 wherein the throttle body forms a single air passage in which a single throttle valve is positioned.

9. A supercharged, twin overhead camshaft, inline internal combustion engine, as set forth in claim 8 wherein the supercharger outer housing forms an air inlet that faces toward one end of said engine.

10. A supercharged, twin overhead camshaft, inline internal combustion engine, as set forth in claim 9 wherein a portion of the compressed air delivered by the supercharger is delivered to the exhaust ports of the engine for reducing the discharge of undesirable pollutants to the atmosphere.

11. A supercharged, twin overhead camshaft, inline internal combustion engine, as set forth in claim 10 wherein the exhaust ports are formed in the main cylinder head member on a side opposite to the intake ports.

12. A supercharged, twin overhead camshaft, inline internal combustion engine, as set forth in claim 11 wherein the supercharger drive includes an elongated shaft having a balance mass thereon for balancing at least in part the unbalanced forces generated by the engine operation.

13. A supercharged, twin overhead camshaft, inline internal combustion engine, as set forth in claim 12 wherein the supercharger drive includes a pair of elongated shafts each driving a respective rotor and each having a balance mass thereon for balancing at least in part the unbalanced forces generated by the engine operation.

14. A supercharged, twin overhead camshaft, inline internal combustion engine, as set forth in claim 3 wherein the supercharger drive includes an elongated shaft having a balance mass thereon for balancing at least in part the unbalanced forces generated by the engine operation.

15. A supercharged, twin overhead camshaft, inline internal combustion engine, as set forth in claim 14 wherein the supercharger drive includes a pair of elongated shafts each driving a respective rotor and each having a balance mass thereon for balancing at least in part the unbalanced forces generated by the engine operation.

* * * * *